US008590307B2

(12) United States Patent
Kopecek et al.

(10) Patent No.: US 8,590,307 B2
(45) Date of Patent: Nov. 26, 2013

(54) AUTO OPTIMIZING CONTROL SYSTEM FOR ORGANIC RANKINE CYCLE PLANTS

(75) Inventors: Herbert Kopecek, Hallbergmoos (DE); Gabor Ast, Garching (DE); Thomas Johannes Frey, Regensburg (DE); Sebastian Freund, Unterfoehring (DE); Pierre Sebastien Huck, Munich (DE)

(73) Assignee: General Electric Company, Niskayuna, NY (US)

( * ) Notice: Subject to any disclaimer, the term of this patent is extended or adjusted under 35 U.S.C. 154(b) by 946 days.

(21) Appl. No.: 12/712,954

(22) Filed: Feb. 25, 2010

(65) Prior Publication Data

US 2011/0203278 A1 Aug. 25, 2011

(51) Int. Cl.
*F01K 25/08* (2006.01)
*F01K 13/02* (2006.01)

(52) U.S. Cl.
USPC ..... 60/618; 60/651; 60/664; 60/667; 60/671

(58) Field of Classification Search
USPC ..... 60/614, 616, 618, 651, 671, 660, 664, 60/667; 415/17
See application file for complete search history.

(56) References Cited

U.S. PATENT DOCUMENTS

| | | | | |
|---|---|---|---|---|
| 4,358,930 | A | 11/1982 | Pope et al. | |
| 6,536,215 | B1 | 3/2003 | Vikstrom | |
| 7,200,996 | B2 | 4/2007 | Cogswell et al. | |
| 7,735,324 | B2 * | 6/2010 | Brasz et al. | 60/651 |
| 8,015,812 | B1 * | 9/2011 | Kesseli et al. | 60/677 |
| 8,186,161 | B2 * | 5/2012 | Ast et al. | 60/660 |
| 2003/0213246 | A1 * | 11/2003 | Coll et al. | 60/653 |
| 2009/0226308 | A1 | 9/2009 | Vandor | |
| 2009/0320477 | A1 * | 12/2009 | Juchymenko | 60/651 |

* cited by examiner

*Primary Examiner* — Hoang Nguyen
(74) *Attorney, Agent, or Firm* — Ann M. Agosti

(57) ABSTRACT

A waste heat recovery plant control system includes a programmable controller configured to generate expander speed control signals, expander inlet guide vane pitch control signals, fan speed control signals, pump speed control signals, and valve position control signals in response to an algorithmic optimization software to substantially maximize power output or efficiency of a waste heat recovery plant based on organic Rankine cycles, during mismatching temperature levels of external heat source(s), during changing heat loads coming from the heat sources, and during changing ambient conditions and working fluid properties. The waste heat recovery plant control system substantially maximizes power output or efficiency of the waste heat recovery plant during changing/mismatching heat loads coming from the external heat source(s) such as the changing amount of heat coming along with engine jacket water and its corresponding exhaust in response to changing engine power.

22 Claims, 2 Drawing Sheets

AUTO OPTIMIZING CONTROL SYSTEM FOR ORGANIC RANKINE CYCLE PLANTS

BACKGROUND

Figure 1:
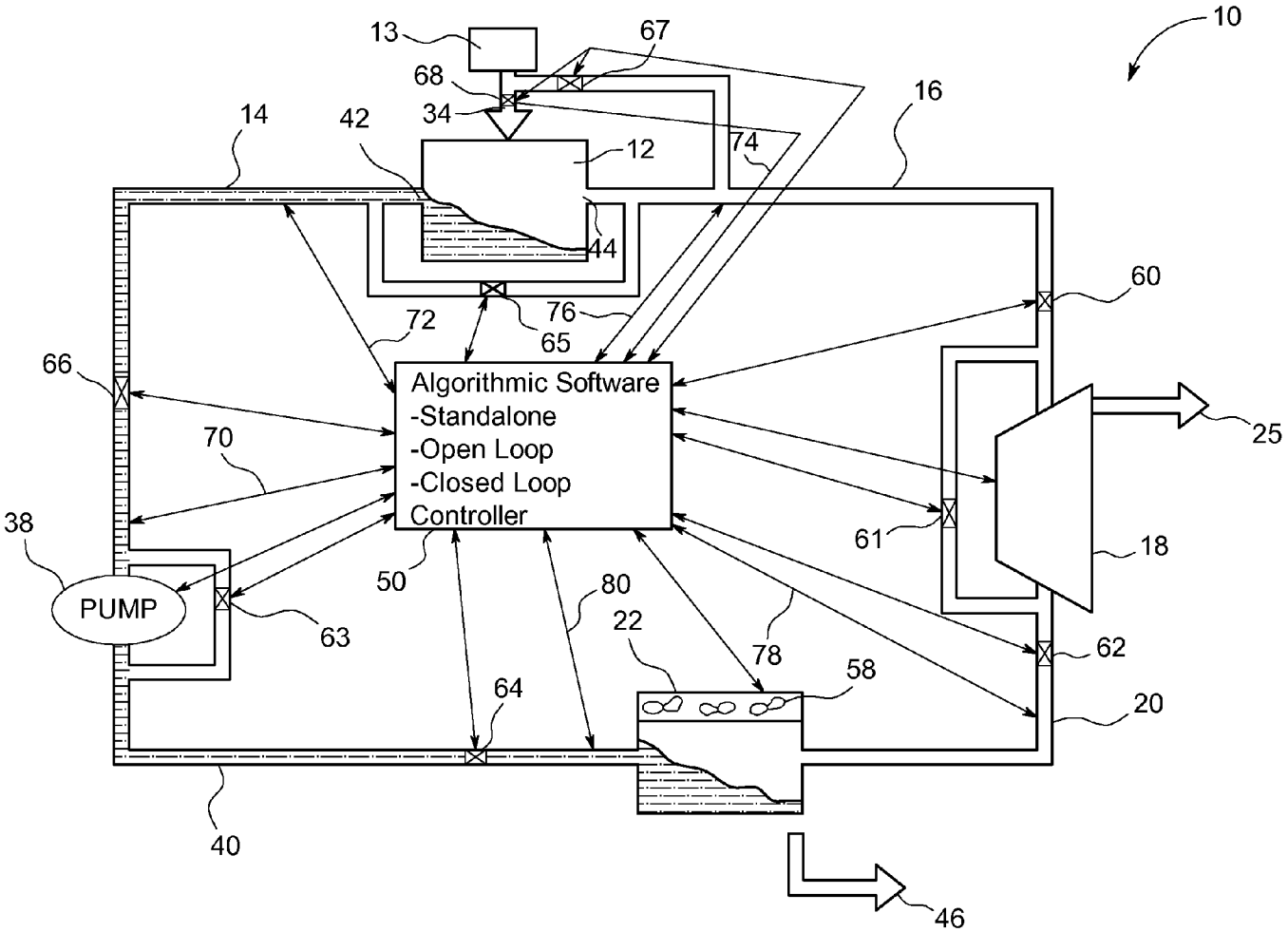

This invention relates generally to organic Rankine cycle plants, and more particularly to methods and systems for maximizing power output or efficiency of waste heat recovery plants that employ organic Rankine cycles using variable speed generators and/or pumps and/or fans.

Rankine cycles use a working fluid in a closed cycle to gather heat from a heating source or a hot reservoir by generating a hot gaseous stream that expands through a turbine to generate power. The expanded stream is condensed in a condenser by rejecting the heat to a cold reservoir. The working fluid in a Rankine cycle follows a closed loop and is re-used constantly. The efficiency of Rankine cycles such as organic Rankine cycles (ORC)s in a low-temperature heat recovery application is very sensitive to the temperatures of the hot and cold reservoirs between which they operate. In many cases, these temperatures change significantly during the lifetime of the plant. Geothermal plants, for example, may be designed for a particular temperature of geothermal heating fluid from the earth, but lose efficiency as the ground fluid cools over time. Air-cooled ORC plants that use an exhaust at a constant temperature from a larger plant as their heating fluid will still deviate from their design operating condition as the outside air temperature changes with the seasons or even between morning and evening.

Waste heat recovery plants based on organic Rankine cycles are often required to work in harmony with different types of heat sources such as engines or turbines of different sizes and power levels. It would be advantageous to provide a control system and method for ensuring optimized organic Rankine cycle plant operation during mismatching temperature levels of the heat source(s) and for changing/mismatching heat load coming from the heat source(s) as well as for changing ambient conditions and fluid properties for waste heat recovery plants that employ variable speed generators and/or pumps and/or fans in which the waste heat recovery plant is based on organic Rankine cycles.

BRIEF DESCRIPTION

According to one embodiment, an organic Rankine cycle (ORC) plant comprises:

one or more primary heaters configured to receive a pressurized working fluid stream and heat from one or more external sources and to generate a vapor stream in response thereto;

at least one expander configured to receive the vapor stream and to generate power and an expanded stream there from in response to expander control signals selected from expander speed control signals when at least one expander comprises a variable speed expander and expander inlet guide vane pitch control signals when at least one expander comprises inlet guide vanes with a variable pitch;

a condensing system comprising one or more variable speed fans and configured to receive and cool the expanded stream and to generate a cooled working fluid stream there from in response to variable speed fan control signals;

one or more variable speed pumps configured to pressurize the cooled working fluid stream in preparation for reintroducing it into the primary heater as a pressurized working fluid stream in response to variable speed pump control signals;

one or more control valves configured to control at least one of pressurized working fluid stream flow, cooled working fluid steam flow, vapor stream control, expanded stream control, and heat flow, in response to valve position control signals; and a control system configured to generate the expander speed control signals when at least one expander comprises a variable speed expander, expander inlet guide vane pitch control signals when at least one expander comprises inlet guide vanes with a variable pitch, variable speed fan control signals, variable speed pump control signals, and valve position control signals in response to an algorithmic optimization software to substantially maximize power output or efficiency of the ORC plant during mismatching temperature levels of external heat sources, during changing heat loads coming from the heat sources, and during changing ambient conditions and working fluid properties.

According to another embodiment, a waste heat recovery plant based on organic Rankine cycles comprises a programmable controller configured to control expander speed when at least one expander comprises a variable speed expander, expander inlet guide vane pitch when at least one expander comprises inlet guide vanes with a variable pitch, fan speed, pump speed and valve position in response to corresponding expander speed control signals, expander inlet guide vane pitch control signals, fan speed control signals, pump speed control signals, and valve position control signals generated via the programmable controller to substantially maximize power output or efficiency of the waste heat recovery plant during mismatching temperature levels of external heat sources, during changing heat loads coming from the heat sources, and during changing ambient conditions and working fluid properties.

DRAWINGS

Figure 2:
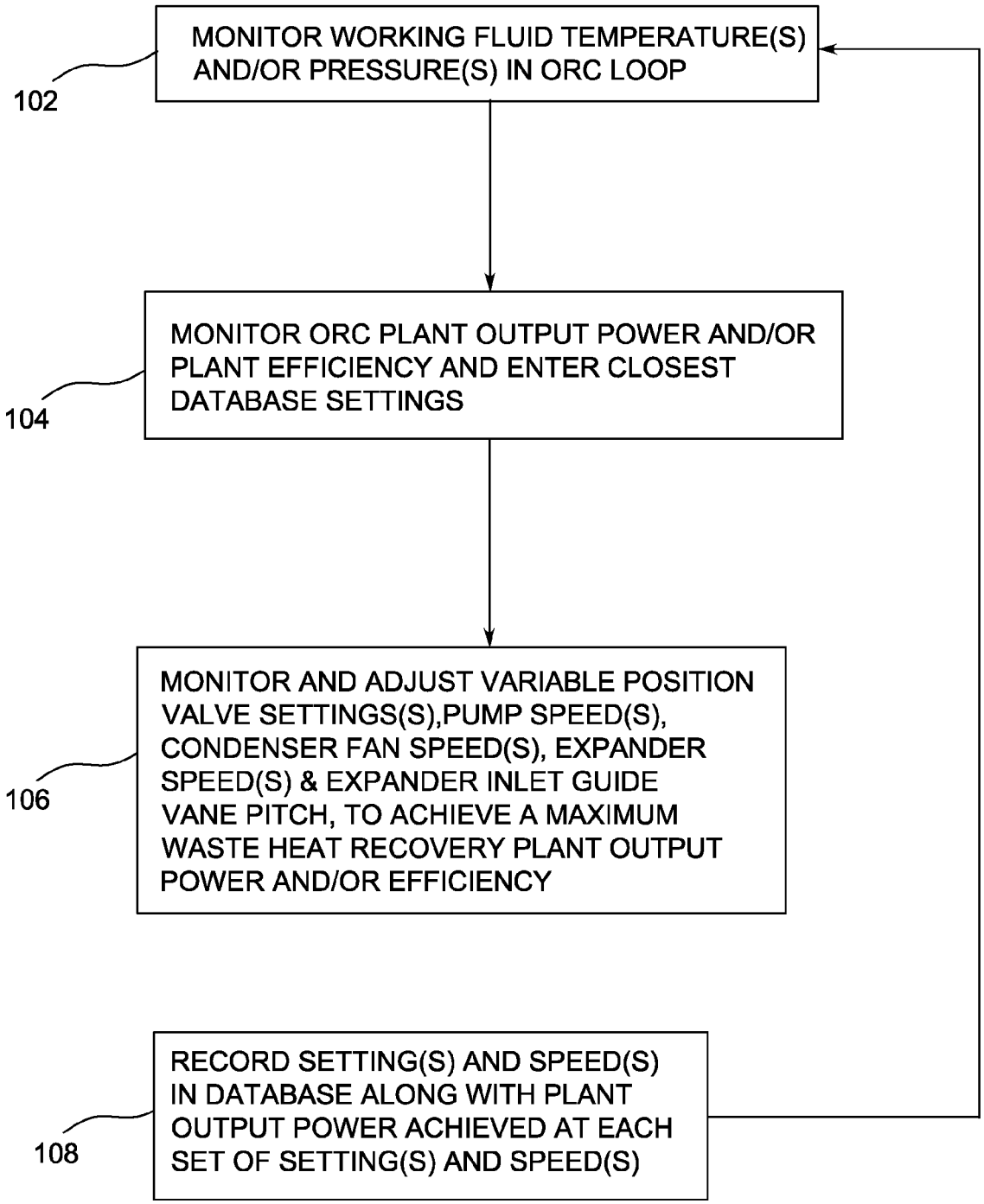

These and other features, aspects, and advantages of the present invention will become better understood when the following detailed description is read with reference to the accompanying drawing, wherein:

FIG. 1 illustrates a waste heat recovery plant based on organic Rankine cycles in which embodiments of the invention are integrated therein; and FIG. 2 is a flow chart illustrating a method of operating the waste heat recovery plant depicted in FIG. 1 to achieve maximum plant output power according to one embodiment.

While the above-identified drawing figures set forth particular embodiments, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION

FIG. 1 represents an exemplary waste heat recovery plant 10 based on organic Rankine cycles for power generation according to one embodiment of the invention. The waste heat recovery plant 10 includes a primary heater 12 such as, for example, a boiler or heat exchanger, configured to receive heat from an external source 13 and a working fluid stream 14 and to generate a vapor stream 16. According to one embodiment, the waste heat recovery plant 10 also includes a variable speed expander 18 such as, for example, a controllable turbine, configured to receive the vapor stream 16 and to generate power 25 by rotating the mechanical shaft (not shown) of the expander 18 and an expanded stream 20. According to another embodiment, the waste heat recovery plant 10 also includes one or more fixed-speed expanders 18. A condenser 22 is configured to receive and condense the expanded stream 20 to generate a cooled working fluid stream 40. A variable speed pump 38 pressurizes the cooled working fluid stream 40 to regenerate the working fluid stream 14. Thus, the vapor stream 16 along with the vapor and liquid phase within the primary heater 12 and condenser 22 form the working fluid of the Rankine cycle shown in FIG. 1.

In a Rankine cycle, the working fluid is pumped (ideally isentropically) from a low pressure to a high pressure by a pump 38. Pumping the working fluid from a low pressure to a high pressure requires a power input (for example mechanical or electrical). The high-pressure liquid stream 14 enters the primary heater 12 where it is heated at constant pressure by an external heat source 13 to become a saturated vapor stream 16. Common heat sources for organic Rankine cycles are exhaust gases from combustion systems (power plants or industrial processes), hot liquid or gaseous streams from industrial processes or renewable thermal sources such as geothermal or solar thermal. The superheated or saturated vapor stream 16 expands through the expander 18 to generate power output (as shown by the arrow 25). In one embodiment, this expansion is isentropic. The expansion decreases the temperature and pressure of the vapor stream 16. The vapor stream 16 then enters the condenser 22 where it is cooled to generate a saturated liquid stream 40. This saturated liquid stream 40 re-enters the pump 38 to generate the liquid stream 14 and the cycle repeats.

As described above, the waste heat recovery plant 10 is based on organic Rankine cycles where the heat input is obtained through the primary heater 12 and the heat output is taken from the condenser 22. In operation, the primary heater 12 is connected to an inlet 42 and outlet 44. The arrow 34 indicates the heat input into the primary heater 12 from the external heat source 13 and the arrow 46 indicates the heat output from the condenser 22 to a cold reservoir. In some embodiments, the cold reservoir is the ambient air and the condenser 22 is an air-cooled or water-cooled condenser. In some embodiments, the working fluid stream 14 comprises two liquids namely a higher boiling point liquid and a lower boiling point liquid. Embodiments of the primary heater 12 and the condenser 22 can include an array of tubular, plate or spiral heat exchangers with the hot and cold fluid separated by metal walls.

Waste heat recovery plants based on organic Rankine cycles are required to work in harmony with different types of heat sources such as engines or turbines of different size and power levels. A modular and scalable system that can be easily adapted for different applications requires a control system which is capable of operating at off-design set points with minimized penalties on efficiency and output power. Such a control system should ensure optimized plant operation, even for mismatching temperature levels of the heat sources, as well as for changing ambient conditions and fluid properties. Such a control system should also ensure optimized plant operation, even for changing and/or mismatching heat load(s) such as, for example and without limitation, changing engine power and therefore changing the amount of heat coming along with the corresponding engine jacket water and the engine exhaust.

Waste heat recovery plant 10 can be seen to include a controller 50 that operates to track maximum power output or efficiency of the waste heat recovery plant 10 based on organic Rankine cycles. Controller 50 includes any suitable algorithmic software 52, such as, without limitation, an extremum seeking algorithm, a reinforcement learning code, a neural network, and so on, to track the maximum operating point under any operating conditions. According to one embodiment, algorithmic software 52 functions as a stand-alone control algorithm. According to another embodiment, algorithmic software 52 functions in combination with any kind of open-loop control algorithm. According to yet another embodiment, algorithmic software 52 functions in combination with any kind of closed-loop control algorithm. The optimizing algorithm 52 alone, or in combination with an open-loop control algorithm or a closed-loop control algorithm for particular applications, provides for unmanned auto-optimization of the plant performance and self tuning for different plant types and sizes. According to particular aspects, controller 50 can influence/control expander speed for applications using one or more variable speed expander(s), pump speed, condenser fan speed, and control valve positions.

With continued reference now to FIG. 1, waste heat recovery plant 10 based on organic Rankine cycles can also be seen to include one or more variable speed condenser fans 58, and one or more control valves 60-68. Control valve 60 is a variable position valve that controls the rate of flow of vapor stream 16. Control valve 62 is a variable position valve that controls the rate of flow of expanded stream 20. Control valve 64 is a variable position valve that controls the rate of flow of cooled fluid 40. Control valve 66 is a variable position valve that controls the rate of flow of working fluid 14. Control valve 68 is a variable position valve that controls the rate of flow of heat input 34. Control valve 61 is a variable position expander bypass valve. Control valve 63 is a variable position pump bypass valve. Control valve 65 is a variable position bypass valve on the ORC side of the primary heater 12. Control valve 67 is a variable position bypass valve on the heat source side of the primary heater 12.

The plant power output 25 is monitored via controller 50 along with liquid pressures and/or temperatures at various predetermined points 70-80 in the organic Rankine cycle. According to one embodiment, operating conditions including liquid pressures and temperatures at the various predetermined points in the Rankine cycle are empirically determined and tabularized along with corresponding plant output power 25, pump 38 speed(s), expander 18 speed(s), condenser fan 58 speed(s), and valve 60-68 position settings, at each predetermined point in the Rankine cycle. In this manner, controller 50 can enter the resultant table and using interpolation can easily determine a best set of operating conditions to achieve the maximum plant output power 25 in response to changing heat source 13 temperature levels as well as for changing ambient conditions and working fluid 14 properties. Some solutions may employ one or more expanders running in fixed-speed mode, where only pump speed(s) and/or fan speed(s) are varied. According to one embodiment, both expander speed and inlet guide vane pitch are controlled individually or in combination when using expanders (turbines) with variable inlet guide vanes.

Although interpolation can be employed to determine the best set of operating conditions to achieve the maximum plant output power and/or efficiency, optimization algorithms, such as described above, can also be employed to determine and achieve a desired best set of operating conditions. Such an optimizing algorithm allows for unmanned automatic optimization of the plant 10 performance and self-tuning for different plant types and size such as stated above. The optimizer can influence/control expander speed(s), expander inlet guide vane pitch, pump speed(s), fan speed(s) and valve position(s) to achieve optimum plant operating conditions resulting in maximized output power and/or efficiency.

FIG. 2 is a flow chart illustrating a method of operating the waste heat recovery plant 10 depicted in FIG. 1 to achieve maximum plant output power and/or efficiency according to one embodiment. The controller 50 monitors Rankine cycle loop working fluid temperatures and/or pressures at one or more points 70-80. Controller 50 further monitors the plant power output 25. Variable position valve settings 60-68 are also monitored by controller 50, along with pump 38 speed(s), condenser fan 58 speed(s), expander 18 speed(s) when using one or more variable speed expanders 18 and/or expander inlet guide vane pitch when using one or more expanders (turbines) with variable inlet guide vanes. Fluid flow according to particular embodiments can thus be controlled via a desired combination of variable position bypass and/or direct stream located valves.

An optimization algorithm 52 that may be a stand-alone optimization algorithm, or that may function in combination with one or more open-loop and/or closed loop control algorithms, adjusts the valve position setting(s), pump speed(s), condenser fan speed(s), expander speed(s), and/or expander inlet guide vane pitch, to achieve a maximum plant output power and/or efficiency in response to changing working fluid temperatures and/or pressures. According to one embodiment, the valve position setting(s), pump speed(s), condenser fan speed(s), expander speed(s), and expander inlet guide vane pitch are saved in a database for future use by the optimization algorithm 52 to allow controller 50 to quickly reset the valve position setting(s), pump speed(s), condenser fan speed(s), expander speed(s), and expander inlet guide vane pitch, whenever a recognized set of working fluid temperature and/or pressures are identified by the optimization algorithm 52. The database can also be employed to reduce the amount of work required by the optimization algorithm 52 to determine the valve position setting(s), pump speed(s), condenser fan speed(s), expander speed(s) and expander inlet guide vane pitch required to achieve a maximum plant output power and/or efficiency simply by locating the set of data points closest to the present operating conditions and initiating the optimization process from that set of data points. In this way, response times required for achieving a maximum plant output power and/or efficiency can be minimized by the optimization algorithm 52.

While the invention has been described in terms of various specific embodiments, those skilled in the art will recognize that the invention can be practiced with modification within the spirit and scope of the claims.

What is claimed is:

1. A waste heat recovery plant based on organic Rankine cycles, the plant comprising:

one or more primary heaters configured to receive a pressurized working fluid stream and heat from one or more external heat sources and to generate a vapor stream in response thereto;

at least one expander configured to receive the vapor stream and to generate power and an expanded stream there from in response to expander control signals selected from expander speed control signals when at least one expander comprises a variable speed expander and expander inlet guide vane pitch control signals when at least one expander comprises inlet guide vanes with a variable pitch;

a condensing system comprising one or more variable speed fans and configured to receive and cool the expanded stream and to generate a cooled working fluid stream there from in response to variable speed fan control signals;

one or more variable speed pumps configured to pressurize the cooled working fluid stream in preparation for reintroducing it into the primary heater as a pressurized working fluid stream in response to variable speed pump control signals;

one or more control valves configured to control at least one of pressurized working fluid stream flow, cooled working fluid steam flow, vapor stream control, expanded stream control and heat flow, in response to valve position control signals; and a control system programmed to generate the expander speed control signals when at least one expander comprises a variable speed expander, expander inlet guide vane pitch control signals when at least one expander comprises inlet guide vanes with a variable pitch, variable speed fan control signals, variable speed pump control signals, and valve position control signals in response to an algorithmic optimization software to substantially maximize power output or efficiency of the waste heat recovery plant during mismatching temperature levels of external heat sources, during changing heat loads coming from the heat sources, and during changing ambient conditions and working fluid properties.

2. The waste heat recovery plant according to claim 1, wherein the external heat sources comprise an engine exhaust and corresponding engine jacket water.

3. The waste heat recovery plant according to claim 1, wherein the control system is further programmed to generate the expander speed control signals, expander inlet guide vane pitch control signals, variable speed fan control signals, variable speed pump control signals, and valve position control signals in response to the algorithmic optimization software to provide unmanned automatic optimization of waste heat recovery plant performance and self-tuning of the waste heat recovery plant in response to different plant types and sizes.

4. The waste heat recovery plant according to claim 1, wherein the control system is further programmed to generate the expander speed control signals, expander inlet guide vane pitch control signals, variable speed fan control signals, variable speed pump control signals, and valve position control signals in response to the algorithmic optimization software in combination with an open-loop algorithmic software.

5. The waste heat recovery plant according to claim 1, wherein the control system is further programmed to generate the expander speed control signals, expander inlet guide vane pitch control signals, variable speed fan control signals, variable speed pump control signals, and valve position control signals in response to the algorithmic optimization software in combination with a closed-loop algorithmic software.

6. The waste heat recovery plant according to claim 1, wherein the one or more external heat sources are selected from engines and fixed and variable speed turbines of different sizes and power levels.

7. The waste heat recovery plant according to claim 1, wherein the control system is further programmed to generate the expander speed control signals, expander inlet guide vane pitch control signals, variable speed fan control signals, variable speed pump control signals, and valve position control signals in response to the algorithmic optimization software to provide a waste heat recovery plant capable of operating at off-design set points with minimized penalties on operating efficiency and output power.

8. The waste heat recovery plant according to claim 7, wherein the waste heat recovery plant is capable of operating at off-design set points with minimized penalties on operating efficiency and output power to provide a modular and scalable waste heat recovery plant.

9. The waste heat recovery plant according to claim 1, wherein the algorithmic optimization software comprises any predetermined optimization algorithm capable of being configured as a stand-alone control algorithm.

10. The waste heat recovery plant according to claim 9, wherein the stand-alone control algorithm is selected from an extremum seeking type algorithm, a reinforcement learning code type algorithm, and a neural network type algorithm.

11. A waste heat recovery plant control system comprising:

at least one expander configured to receive a vapor stream and to generate power and an expanded stream there from in response to expander control signals selected from expander speed control signals when at least one expander comprises a variable speed expander and expander inlet guide vane pitch control signals when at least one expander comprises inlet guide vanes with a variable pitch;

at least one device selected from a variable speed fan, a variable speed pump, and a variable position control valve; and a programmable control system programmed to control expander speed when the expander comprises a variable speed expander, expander inlet guide vane pitch when the expander comprises inlet guide vanes with a variable pitch, fan speed when the at least one device comprises a variable speed fan, pump speed when the at least one device comprises a variable speed pump and valve position when the at least one device comprises a variable speed control valve in response to corresponding expander speed control signals, expander inlet guide vane pitch control signals, fan speed control signals, pump speed control signals, and valve position control signals generated via the programmable control system to substantially maximize power output or efficiency of the waste heat recovery plant during mismatching temperature levels of external heat sources, during changing heat loads coming from the heat sources, and during changing ambient conditions and working fluid properties.

12. The waste heat recovery plant control system according to claim 11, wherein the mismatching temperature levels of external heat sources comprise mismatching temperature levels between an engine exhaust and corresponding engine jacket water.

13. The waste heat recovery plant control system according to claim 11, further comprising one or more primary heaters configured to receive a pressurized working fluid stream and heat from one or more external heat sources and to generate a vapor stream in response thereto.

14. The waste heat recovery plant control system according to claim 11, further comprising a condensing system comprising one or more variable speed fans and configured to receive and cool the expanded stream and to generate a cooled working fluid stream there from in response to the fan speed control signals.

15. The waste heat recovery plant control system according to claim 14, further comprising one or more variable speed pumps configured to pressurize the cooled working fluid stream in preparation for reintroducing it into the primary heater as a pressurized working fluid stream in response to the pump speed control signals.

16. The waste heat recovery plant control system according to claim 15, further comprising one or more control valves configured to control at least one of pressurized working fluid stream flow, cooled working fluid steam flow, vapor stream control, expanded stream control and heat flow, in response to the valve position control signals.

17. The waste heat recovery plant control system according to claim 11, wherein the programmable control system is further programmed to generate the expander speed control signals, expander inlet guide vane pitch control signals, fan speed control signals, pump speed control signals, and valve position control signals in response to the algorithmic optimization software to provide unmanned automatic optimization of waste heat recovery plant performance and self-tuning of the waste heat recovery plant in response to different plant types and sizes.

18. The waste heat recovery plant control system according to claim 11, wherein the programmable control system is further programmed to generate the expander speed control signals, expander inlet guide vane pitch control signals, fan speed control signals, pump speed control signals, and valve position control signals in response to the algorithmic optimization software in combination with an open-loop algorithmic software.

19. The waste heat recovery plant control system according to claim 11, wherein the programmable control system is further programmed to generate the expander speed control signals, expander inlet guide vane pitch control signals, fan speed control signals, pump speed control signals, and valve position control signals in response to the algorithmic optimization software in combination with a closed-loop algorithmic software.

20. The waste heat recovery plant control system according to claim 11, wherein the programmable control system is further programmed to generate the expander speed control signals, expander inlet guide vane pitch control signals, fan speed control signals, pump speed control signals, and valve position control signals in response to the algorithmic optimization software to provide a waste heat recovery plant capable of operating at off-design set points with minimized penalties on operating efficiency and output power.

21. The waste heat recovery plant control system according to claim 20, wherein the waste heat recovery plant is capable of operating at off-design set points with minimized penalties on operating efficiency and output power to provide a modular and scalable waste heat recovery plant based on ORCs.

22. The waste heat recovery plant control system according to claim 11, wherein the algorithmic optimization software comprises any predetermined optimization algorithm capable of being configured as a stand-alone control algorithm.

* * * * *